US006490963B2

(12) United States Patent
Ennemark et al.

(10) Patent No.: US 6,490,963 B2
(45) Date of Patent: Dec. 10, 2002

(54) HYDRAULIC LINE COUPLING ARRANGEMENT

(75) Inventors: Poul Ennemark, Sønderborg (DK); Siegfried Zenker, Kirchseeon (DE)

(73) Assignee: Sauer-Danfoss (Nordborg) A/S, Nordborg (DK)

( * ) Notice: Subject to any disclaimer, the term of this patent is extended or adjusted under 35 U.S.C. 154(b) by 77 days.

(21) Appl. No.: 09/833,951

(22) Filed: Apr. 12, 2001

(65) Prior Publication Data

US 2002/0000158 A1 Jan. 3, 2002

(30) Foreign Application Priority Data

Mar. 31, 2000 (DE) ..... 100 16 026

(51) Int. Cl.[7] ..... F15B 13/01

(52) U.S. Cl. ..... 91/432; 60/399; 60/403; 137/595

(58) Field of Search ..... 60/399, 403; 91/432; 137/595

(56) References Cited

FOREIGN PATENT DOCUMENTS

| | | | |
|---|---|---|---|
| DE | 3816987 | * 11/1989 | ..... 60/399 |
| DE | 4113202 | * 11/1992 | ..... 60/403 |

* cited by examiner

*Primary Examiner*—F. Daniel Lopez
(74) *Attorney, Agent, or Firm*—Lee, Mann, Smith, McWilliams, Sweeney & Ohlson

(57) ABSTRACT

The invention concerns a hydraulic line coupling arrangement of a consumer, with a pump line, a tank line and a safety valve in the pump line, the valve element of the safety valve being acted upon in the opening direction by an opening pressure from the pump line and in the closing direction by a closing pressure of a closing pressure connection. In such an arrangement it is desired to prevent overloading of the consumer. For this purpose, a pilot valve is provided for controlling the closing pressure, the position of the pilot valve being controlled by the pressure in the tank line.

9 Claims, 1 Drawing Sheet

HYDRAULIC LINE COUPLING ARRANGEMENT

Figure 1:
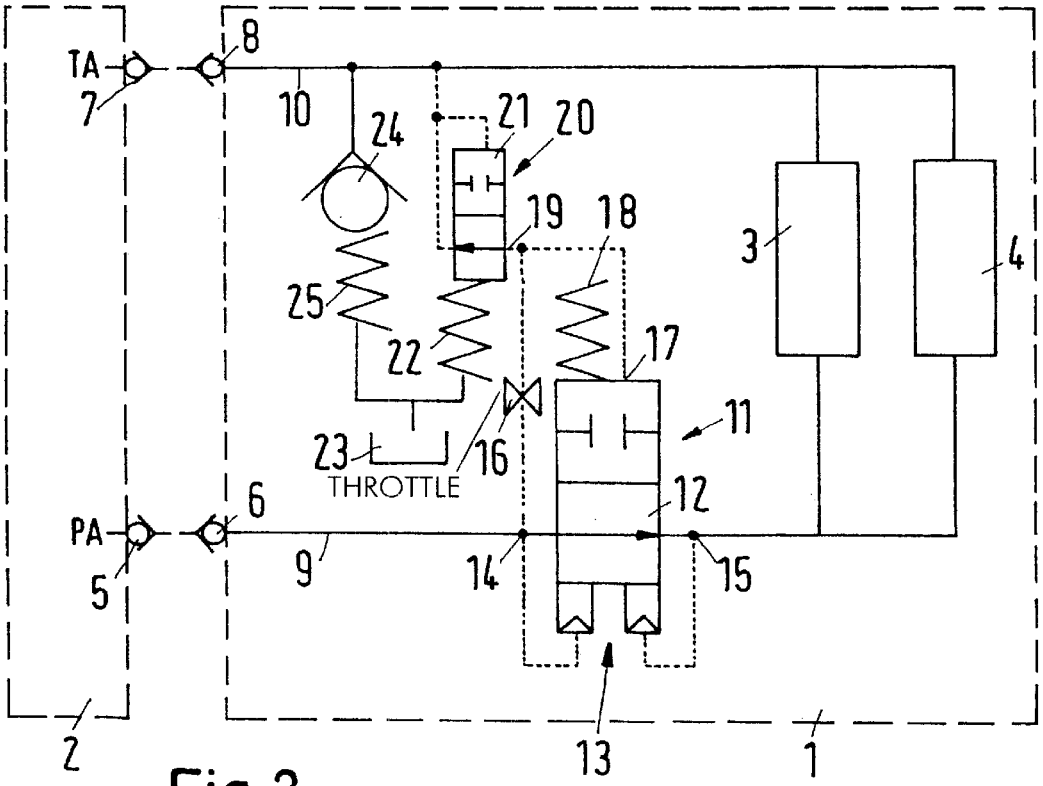

The invention concerns a hydraulic line coupling arrangement of a consumer, with a pump line, a tank line and a safety valve in the pump line, the valve element of the safety valve being acted upon in the opening direction by an opening pressure from the pump line and in the closing direction by a closing pressure of a closing pressure connection.

A line coupling arrangement of this kind is known from the previous German patent application 199 22 866.3. When the consumer is connected with a supplier, the inlet valves of the pump line and the tank line are opened, so that the pressure in the pump line can get from the supplier to the consumer and the hydraulic fluid displaced by this can get back to the supplier via the tank line. Application examples for a hydraulic line coupling of this kind are tractors and other agricultural machines with different attachments, the attachments, for example a revolving mower or a loader wagon, requiring not only a mechanical connection with the tractor but also a hydraulic supply. When, in connection with such a line coupling, the tank line is not correctly connected with the supplier, the tank line is closed at the supplier end. Accordingly, the pump pressure in the tank line increases and closes the safety valve, so that the hydraulic attachments of the consumer connected downstream of the safety valve are not loaded by the pump pressure for a long time.

DE 38 16 987 C1 shows a safety valve for a line coupling arrangement, which is installed on the consumer. This safety valve blocks a pump line for as long as a coupling connection to the tank line of the consumer has not been established. When establishing this coupling connection, not only the valves at both ends of the tank line of supplier and consumer are opened, but also a pressure decrease is caused on the closing side of the safety valve via a valve operated mechanically by means of a tappet, so that the pump pressure can move the safety valve to the open position.

DE 37 28 986 A1 shows another safety valve for hydraulic rotary drives, said valve also being arranged on the supplier. On the tank coupling, that is, the coupling part connecting the tank line of the consumer with the tank line of the supplier, a valve slide is provided, which is displaced on the establishment of the coupling connection. As long as this valve slide has not yet-been displaced, it ensures a connection of the tank line to a branch of the pump line of the supplier, so that hydraulic fluid still remaining in the supplier can flow back to the tank.

The invention is based on the task of preventing an overloading of the consumer in connection with an incorrect coupling.

In the hydraulic line coupling arrangement mentioned in the introduction, this task is solved in that a pilot valve is provided for controlling the closing pressure, the position of the pilot valve being controlled by the pressure in the tank line.

Thus, it is possible to fit the safety valve in or at the consumer, that is, the safety measures for the consumer and its hydraulic attachments can be provided in the immediate proximity of the consumer. The safety arrangement, that is, the safety valve can be directly adapted to the requirements of the individual consumer, for example the possible maximum pressure, which should be permissible, also in case of errors, which is not possible when the safety valve is arranged at the supplier supplying varying consumers. The use of the pilot valve involves a higher degree of freedom in connection with the selection and embodiment of the closing pressure. In case of errors, the pilot valve ensures a very quick building up of the required closing pressure for the safety valve.

It is preferred that in the closing direction the valve element is loaded by a spring, the pilot valve being controllable in such a way that the pressure of the pump line also acts in the closing direction. Normally, it must be assumed that the pressure in the pump line is the highest pressure in the consumer. Enabling this pressure also to act in the closing direction initially causes the establishment of an equilibrium on the valve element. By means of the spring force, the valve element can be moved to its closing position. Thus, it is possible for the valve element to perform both its opening movement and its closing movement relatively fast, as the valve element is acted upon by the higher of the ruling pressures.

In a first alternative it is provided that the pump line is connected with the closing pressure connection via a throttle, the pilot valve releasing or blocking a connection between the closing pressure connection and the tank line. When the pilot valve releases the connection between the closing pressure connection and the tank line, the pressure available at the closing pressure connection is the same as the pressure available in the tank line. The throttle then produces a pressure drop, which corresponds to the pressure difference between the pump line and the tank line. The valve element of the safety valve remains open, as it is acted upon in the opening direction by the pressure in the pump line. When now the pilot valve closes, firstly the connection between the closing pressure connection and the tank line is blocked. At the same time, however, hydraulic fluid from the pump line reaches the closing pressure connection via the throttle, that is, very quickly the pressure of the pump line will also be available at the closing pressure connection, this pressure, together with the spring, displacing the valve element to its closing position.

In an alternative embodiment it is provided that the pilot valve is made as a three-way valve, which in one position connects the pump line with the closing pressure connection and in another position connects the closing pressure connection with the tank line. When the closing pressure connection is connected with the tank line, the pressure in the tank line is also available at the closing pressure connection, that is, the safety valve is open, as the pressure acting upon the valve element in the opening direction is higher than the pressure in the closing direction. When, however, the pilot valve is changed over, the pressure in the pump line reaches the closing pressure connection directly, so that the safety valve is closed.

Preferably, the pilot valve is acted upon by a spring against the direction of the pressure of the tank line in the direction of a position, in which the closing pressure connection is connected with the tank line. In a manner of speaking, this position is the position for the normal operation, during which the tank pressure of the supplier is available in the tank line of the consumer. In this case, the force of the spring on the pilot valve is higher than the force, which the pressure in the tank line can produce. When, however, the tank line is no longer or not correctly connected with the tank line of the supplier, be it through a released or not correctly connected coupling, hydraulic fluid can no longer or not to a sufficient degree flow off through the tank line, so that the pressure in the tank line increases. As soon as the pressure in the tank line is so high that it overcomes the force of the spring on the pilot valve, the pilot valve is changed over, which immediately causes the closing of the safety valve.

Preferably, the consumer has a consumer tank. This provides an additional measure that may cause a pressure release in the consumer. The consumer tank does not have to be big. It is sufficient, when the consumer tank can hold a hydraulic fluid quantity, which has to be drained off from the consumer or its attachments, respectively, to initiate a desired pressure decrease after the closing of the safety valve.

In this connection, it is preferred that the tank line is connected with the consumer tank via a safety valve. During "normal operation" the safety valve ensures that no hydraulic fluid flows off into the consumer tank. This will not happen until the pressure in the tank line exceeds a predetermined value. The safety valve releases at a pressure that is higher than the pressure required for the adjustment of the pilot valve.

It is also preferred that a control connection on the spring loaded side of the pilot valve is connected with the consumer tank. In this connection it is taken into consideration that on the one hand certain leakages may occur at the pilot valve and on the other hand the hydraulic fluid required for the control of the pilot valve also has to be displaced to somewhere.

Preferably, the opening pressure is available in an opening pressure connection, which is connected with the inlet and the outlet of the safety valve. Independently of the position of the valve element of the safety valve, an opening pressure is thus always available, so that after eliminating the error in the tank coupling line the valve element can always be returned to its opening position again.

In the following the invention is described on the basis of preferred embodiments in connection with the drawings, showing:

FIG. 1 a first embodiment of a coupling arrangement

Figure 2:
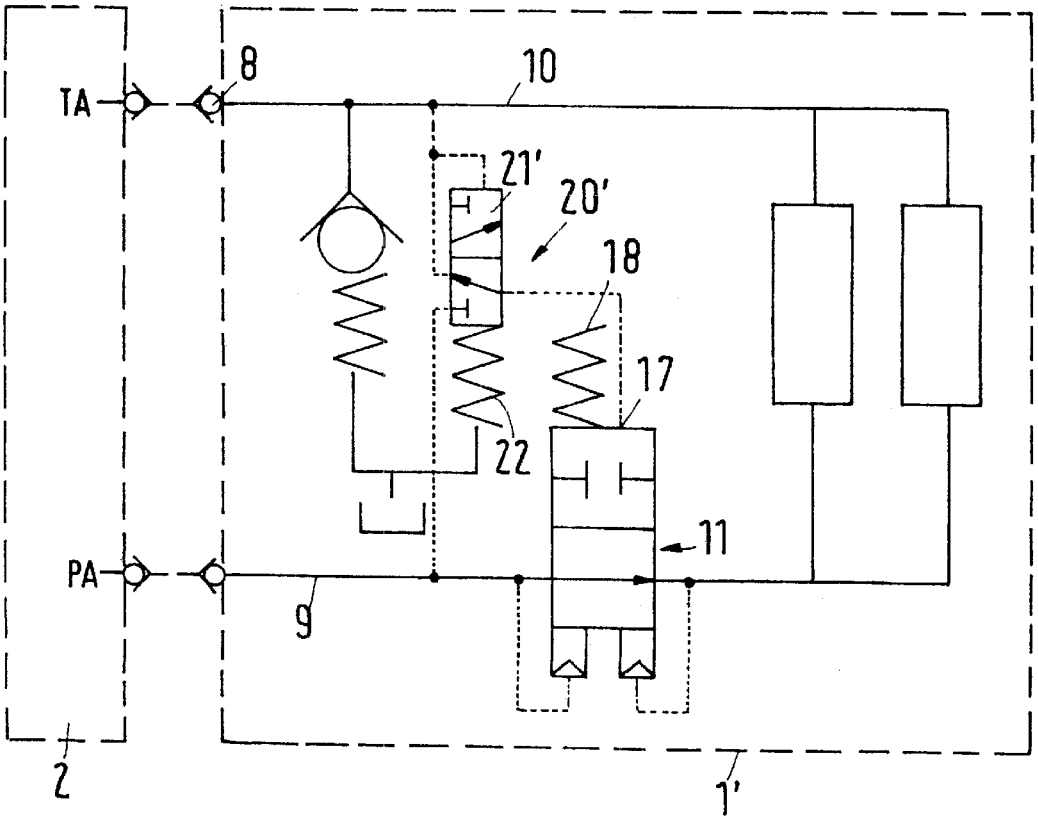

FIG. 2 a second embodiment

FIG. 1 shows a consumer 1 that has to be connected with a supplier 2. The supplier 2 is, for example, a tractor or another working machine, which is operated with different attachments, for example, with a revolving mower, a lift frame, a loading device or the like.

Further to a mechanical connection (not shown in detail) between the supplier 2 and the consumer 1, a hydraulic connection is required, through which pressurized hydraulic fluid can get from the supplier 2 to the consumer 1 and back again, in order that the attachments 3, 4, for example lifting cylinders or rotary drives, of the consumer 1 can be operated in the desired way.

For this purpose, the supplier 2 has a coupling valve 5 on its pump outlet PA, which can be coupled with a coupling valve 6 on the pump line 9 of the consumer 1. The coupling valves 5, 6 are only open, when the corresponding coupling connection between the pump outlet PA and the pump line 9 is established. As soon as this connection—for whatever reason—is interrupted mechanically, the coupling valves 5, 6 are closed.

The supplier 2 has a coupling valve 7 on its tank outlet TA that cooperates with a coupling valve 8 in a tank line 10 of the consumer 1. Also the coupling valves 7, 8 are only open, when the coupling connection between the tank outlet TA and the tank line 10 is established. Otherwise, the two coupling valves 7, 8 are closed.

When the "pump connection" is not installed correctly, the only consequence is that the consumer 1, or its attachments 3, 4, respectively, cannot work, as they are missing the hydraulic pressure. Normally, this does not involve any risk of damaging. However, the situation is quite different, when the "tank connection" is not properly installed or is detached during operation. In this case, the coupling valve 8 closes, so that the pressure in the tank line 10 increases. Thus, the attachments 3, 4 will continuously be loaded with a too high pressure on their outlet side, which may cause a damaging.

To avoid this risk, a safety valve 11 is arranged in the pump line 9, whose valve element 12, in the first switching position shown, interconnects the pump line 9, that is, enables a connection between the coupling valve 6 and the attachments 3, 4. This position is also called "opening position". In its second position, the valve element 12 blocks the pump line, that is, blocks a connection between the coupling valve 6 and the attachments 3, 4.

In the opening direction, the valve element 12 is acted upon by an opening pressure in an opening pressure connection 13, which is connected with both the inlet 14 and the outlet 15 of the safety valve. The inlet 14 of the safety valve 11 is connected with a closing pressure connection 17 of the safety valve 11 via a throttle 16, and in the closing pressure connection 17 a closing pressure is available that loads the valve element 12 in the direction of its closing position. Additionally, the force of a spring 18 is available on this side, which also loads the valve element 12 in the closing direction.

The closing pressure connection 17 is connected with an inlet 19 of the pilot valve 20, whose valve element 21 also has two positions. In the shown "opening position" the pilot valve 20 connects the closing pressure connection 17 with the tank line 10. Through the force of a spring 22, the valve element 21 is loaded in the direction of this position. In the opposite direction, the valve element 21 of the pilot valve 20 is loaded by the pressure in the tank line 10. By means of the spring 22, it can to a high degree be determined, at which pressure in the tank line the pilot valve 20 is displaced from the opening position shown in FIG. 1 to its closing position, in which the connection between the closing pressure connection 17 and the tank line 10 is blocked.

Further, a consumer tank 23 is provided that is connected with the tank line 10 via an overpressure valve 24. The overpressure valve 24 opens at a predetermined pressure in the tank line 10, which can be determined by means of a spring 25. A control connection of the pilot valve 20 also flows into the consumer tank 23 on the side, on which the spring 22 is arranged.

The line coupling connection shown works as follows:

When both coupling connections 5, 6 and 7, 8 work properly, pressurized hydraulic fluid flows from the pump connection PA of the supplier 2 via the pump line 9 and the open safety valve 11 to the attachments 3, 4 and from there via the tank line 10 back to the tank connection TA of the supplier 2.

If, however, the tank coupling does not work properly and the coupling valve 8 is closed or has an increased resistance, the pressure in the tank line 10 increases. When the pressure in the tank line 10 is so high that it exceeds the force of the spring 22 on the valve element 21 of the pilot valve, the pilot valve 20 is changed over and the connection between the closing pressure connection 17 of the control valve 11 and the tank line 10 is blocked. Thus, the hydraulic fluid from the pump line 9, which is supplied via the throttle 16, can no longer flow off, so that the pressure at the closing pressure connection 17 very quickly increases to the pressure in the pump line 9. As this pressure, and additionally also the force of the spring 18, act upon the valve element 12, the valve element 12 is displaced to its closing position, in which it blocks the pump line 9. Thus, no pressure can reach the attachments 3, 4 that cannot be drained off again. A possible pressure still available at the outlet of the attachments 3, 4 can flow off to the consumer tank 23 via the overpressure valve 24. Expediently, the overpressure valve 24 only opens at a pressure, which is higher than the change-over pressure of the pilot valve 20.

FIG. 2 shows a modified embodiment, in which substantially only the pilot valve is made and "connected" differently. The other elements are unchanged in relation to the embodiment in FIG. 1 and accordingly also have the same reference numbers.

The pilot valve 20' is now a three-way valve, whose valve element 21', in the position shown, connects the control pressure connection 17 with the tank line 10. In the other position, the valve element 21' of the pilot valve 20' connects the pump line 9 with the control pressure connection 17. In this case, the valve element 21' is displaced to the "opening position" shown in FIG. 2 by the force of a spring 22, whereas the pressure in the tank line 10 displaces the valve to the "closing position" (not shown), when the pressure in the tank line 10 is sufficient to overcome the force of the spring 22.

In principle, the mode of functioning is the same as in FIG. 1. When the hydraulic fluid can flow off from the tank line 10 to the supplier, the normal tank pressure of for example 5 bar is available in the tank line 10. When, due to a faulty connection, a damage or for some other reason, the coupling valve 8 no longer permits any or enough hydraulic fluid to flow off, the pressure in the tank line 10 increases. This pressure now acts upon the valve element 21' of the pilot valve 20' and displaces the valve element 21' so that the pump line 9 is connected with the control pressure connection 17. The pressure of the pump line 9 and the force of the spring 18 are sufficient to close the safety valve 11.

The terms "pump" and "tank" and pump line and tank line, respectively, were used in the description for simplicity reasons. However, it is obvious that also other pressure sources or pressure sinks can be used to supply the consumers 1, 1'.

What is claimed is:

1. Hydraulic line coupling arrangement of a consumer, comprising a pump line, a tank line and a safety valve in the pump line, the safety valve having a valve element acted upon in an opening direction by an opening pressure from the pump line and in a closing direction by a closing pressure of a closing pressure connection, and including a pilot valve for controlling the closing pressure, the pilot valve having a position controlled by pressure in the tank line.

2. Arrangement according to claim 1, in which in the closing direction the valve element is loaded by a spring, the pilot valve being controllable in such a way that the pressure of the pump line also acts in the closing direction.

3. Arrangement according to claim 1, in which the pump line is connected with the closing pressure connection via a throttle, the pilot valve releasing or blocking a connection between the closing pressure connection and the tank line.

4. Arrangement according to claim 1, in which the pilot valve is three-way valve, which in one position connects the pump line with the closing pressure connection and in another position connects the closing pressure connection with the tank line.

5. Arrangement according to claim 3, in which the pilot valve is acted upon by a spring against the direction of the pressure of the tank line and in the direction of a position, in which the closing pressure connection is connected with the tank line.

6. Arrangement according to claim 1, in which the consumer includes a consumer tank.

7. Arrangement according to claim 6, in which the tank line is connected with the consumer tank via an overpressure valve.

8. Arrangement according to claim 6, in which a control connection on a spring loaded side of the pilot valve is connected with the consumer tank.

9. Arrangement according to claim 1, in which the opening pressure is available in an opening pressure connection, which is connected with the inlet and the outlet of the safety valve.

* * * * *